US011691058B2

(12) United States Patent
Gordis

(10) Patent No.: US 11,691,058 B2
(45) Date of Patent: Jul. 4, 2023

(54) GOLF BAG WITH PROTECTIVE LAYER

(71) Applicant: Jose Gordis, Yonkers, NY (US)

(72) Inventor: Jose Gordis, Yonkers, NY (US)

(73) Assignee: Jose Gordis, Yonkers, NY (US)

( * ) Notice: Subject to any disclaimer, the term of this patent is extended or adjusted under 35 U.S.C. 154(b) by 0 days.

(21) Appl. No.: 17/192,117

(22) Filed: Mar. 4, 2021

(65) Prior Publication Data

US 2021/0275886 A1 Sep. 9, 2021

Related U.S. Application Data

(60) Provisional application No. 62/984,907, filed on Mar. 4, 2020.

(51) Int. Cl.
*A63B 55/00* (2015.01)
*A63B 55/40* (2015.01)

(52) U.S. Cl.
CPC ..... *A63B 55/406* (2015.10); *A63B 55/40* (2015.10); *A63B 55/408* (2015.10); *A63B 2209/00* (2013.01)

(58) Field of Classification Search
CPC ..... A63B 55/406; A63B 55/40; A63B 55/408; A63B 2209/00; A63B 55/00
USPC ..... 206/315.4
See application file for complete search history.

(56) References Cited

U.S. PATENT DOCUMENTS 4,142,563 A * 3/1979 Ackerfeldt ..... A63B 55/40 206/315.6
4,174,747 A * 11/1979 Boles ..... A63B 55/40 206/315.6
4,522,300 A * 6/1985 Hamblet ..... A45B 11/00 224/274
4,685,561 A * 8/1987 Reimers ..... A63B 55/57 206/315.6
4,911,292 A * 3/1990 Airey, Jr. ..... A63B 55/00 206/315.3
D344,626 S * 3/1994 Landa ..... D3/271.4
5,297,570 A * 3/1994 Conner ..... A45B 11/00 135/25.1
5,862,910 A * 1/1999 Dahlsten ..... A63B 55/406 150/159
5,904,247 A * 5/1999 Voelkner, Jr. ..... E05B 73/0005 150/159
6,330,944 B1 12/2001 DeMichele
2007/0045139 A1* 3/2007 Vosloo ..... A63B 55/40 206/315.6
2009/0033050 A1 2/2009 Ting
2009/0250148 A1* 10/2009 Roberts, II ..... A63B 55/00 150/159

(Continued)

OTHER PUBLICATIONS

International Preliminary Report on Patentability, dated Sep. 6, 2022, pp. 1-7.

*Primary Examiner* — Jennifer Robertson
*Assistant Examiner* — Jessica Kavini Tamil
(74) *Attorney, Agent, or Firm* — Travis Banta; Loyal IP Law, PLLC

(57) ABSTRACT

This disclosure generally relates to a golf bag. The golf bag includes a protective layer which extends entirely along a length of the golf bag. The golf bag may further include a plurality of dividers which provide a plurality of separate individual cavities that selectively retain and capture a golf club. The golf bag may include a removable cap which also includes a protective layer.

20 Claims, 4 Drawing Sheets

(56) References Cited

U.S. PATENT DOCUMENTS

| | | | | |
|---|---|---|---|---|
| 2015/0047997 | A1* | 2/2015 | Gaerlan | A63H 3/005 206/315.5 |
| 2016/0016058 | A1* | 1/2016 | Mashburn | A45F 3/04 224/653 |
| 2017/0095712 | A1* | 4/2017 | Johnston | A63B 55/10 |
| 2021/0308540 | A1* | 10/2021 | Bom | A63B 55/50 |

* cited by examiner

GOLF BAG WITH PROTECTIVE LAYER

CROSS-REFERENCE TO RELATED APPLICATIONS

This application claims the benefit of U.S. Provisional Application No. 62/984,907, filed Mar. 4, 2020, which is hereby incorporated by reference herein in its entirety, including but not limited to those portions that specifically appear hereinafter, the incorporation by reference being made with the following exception: In the event that any portion of the above-referenced provisional application is inconsistent with this application, this application supersedes said above-referenced provisional application.

BACKGROUND

1. Technical Field

This disclosure relates generally to a golf bag. More specifically, the golf bag disclosed herein includes a protective layer which extends along a length of an external surface of the golf bag. The golf bag may further include a cap which extends the protective layer along a length of an external surface of the cap.

2. Description of the Related Art

Golf bags are, in most cases, necessary for the serious play of the sport of golf. Golf bags are typically suited to hold a plurality of golf clubs which are each different types of clubs. For example, a set of golf clubs carried in a golf bag may include clubs that excel for particular types of golf shots that may be encountered during a typical round of golf. Types of golf clubs may include a sand wedge for hitting a ball out of a sand bunker, one or more so-called irons for hitting the ball in a higher arc, a driver for hitting the ball in a longer arc, and a putter for putting on the green. A greater variety of clubs in the bag provides a higher likelihood that a golfer will have access to the ideal club during a round of golf.

Golf bags have typically been fitted with a layer of plastic or metal on a base of the golf bag to protect the bag from both the ground and clubs being inserted back into the bag by an unhappy golfer. The purpose of this base has been to ensure that the golf bag may stand more or less upright, protect the bag from wet, muddy, or rocky conditions, and to support the fabric at the bottom of the golf bag that typically contains the golf clubs within the golf bag. Some golf clubs have so-called "kick-stands" or supports that extend out from the bag to prop the bag up of the ground. Conventional golf bags have not historically been intended to lay on the ground due to mud, dew, rain, grass stains, and other natural conditions.

U.S. Pat. No. 9,474,949 teaches a golf bag base which may be mounted along an exterior surface of the golf bag. The base is intended to allow the bag to rest on the ground but, at the same time, protect the bag from natural conditions such as mud, dew, rain, grass stains, among others. This golf bag base is intended to flex on an incline when the base is set on an incline. As such a break in flexible area of the golf bag base is provided to allow the base to fully contact the ground even when disposed on an inclined surface.

Conventional golf bags, however, are not intended to lay flat on the ground without being temporarily or permanently stained by natural conditions. While some golfers may find disposing a golf bag on the ground to be inconvenient, a golf bag on the ground cannot fall over and cause damage to the valuable clubs inside the golf bag. Further, since the golf bag disclosed herein is intended to optionally be laid on the ground or remain upright during use, it is desirable to provide a certain degree of flexibility to the golf bag which allows virtually all of the golf bag to be resting on the ground even in uneven conditions.

Therefore, a need exists to provide a golf bag that includes a protective layer and provides a cap with a protective layer to protect valuable golf clubs within the golf bag. It is a further need to allow such a golf bag to enjoy a degree of flexibility by installing the protective layer in such a manner as to vary in width over the length of the golf bag.

SUMMARY

Consistent with embodiments disclosed herein, golf bag is disclosed. The golf bag includes a body. The body may include a protective layer which extends along the length of the body of the golf bag. The golf bag may further include a removable cap which also includes a protective layer which extends along the length of the cap.

In another embodiment, a golf bag is disclosed. The golf bag may include a protective layer disposed along an entirety of a length of the golf bag. The protective layer may include a first width, a second width, and a third width. The first width may be wider than the second width and the third width. The second width may be narrower than the first width and the third width. And the third width may be narrower than the width of the first width but wider than the width of the second width.

BRIEF DESCRIPTION OF THE DRAWINGS

The accompanying drawings illustrate several embodiments of the golf bag and constitute a part of the specification. The illustrated embodiments are exemplary and do not limit the scope of the disclosure.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
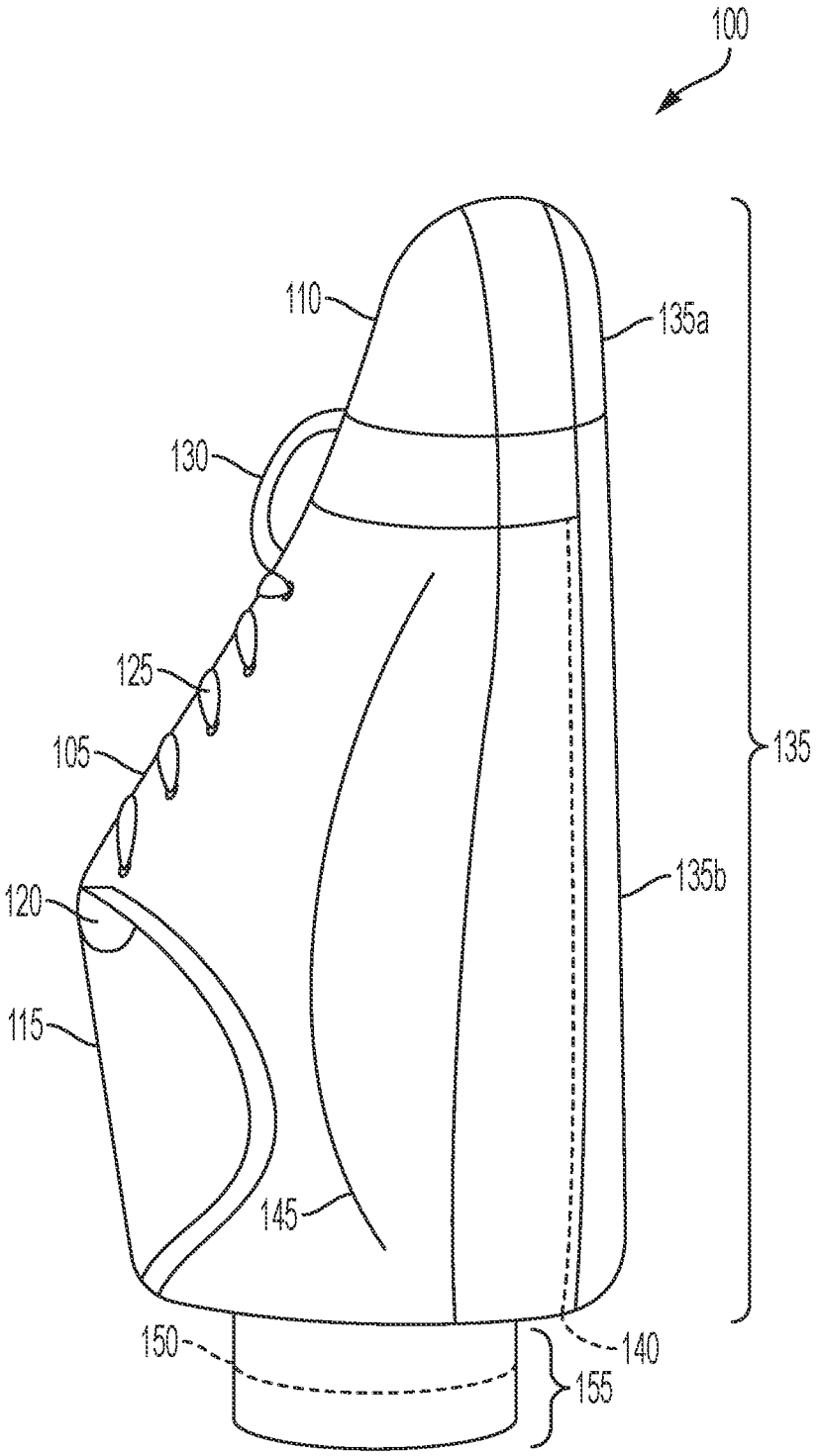
FIG. 1 illustrates a side view of a golf bag with installed cap.

FIG. 1 illustrates a side view of a golf bag 100 having a bag portion 105 with installed cap 110. Both bag portion 105 and cap 110 may be made from natural and synthetic materials such as leather, polymers, and plastic. Bag portion 105 may include a pocket 115 which may be generally circular in shape and which, optionally, may meet with a tongue 120 to open and close. For example, tongue 120 may include a magnet latch which interfaces with pocket 115 to close pocket 115 and, thereby, also seal a pocket contained under tongue 120. Bag portion 105 may further be fitted with lacing 125 which traverses, preferably, in an "X" shaped crossing pattern. Lacing 125 may be an "open" pocket in which lacing material may retain items within lacing 125 while at the same time allow items to pass through lacing 125. For example, a yardage book, package of golf tees, or a bottle of water may be inserted under lacing 125 and retained for use during the game. Bag portion 105 may further be fitted with a handle 130 as a convenient handhold for picking up and manipulating golf bag 100. Handle 130 may also serve as a connection point for an optional shoulder strap (not shown) which allows a user to hang the weight of the bag on their shoulder rather than solely by hand.

On an exterior surface of both bag portion 105 and cap 110 along a side that is opposite the side of golf bag 100 that includes handle 130, for example, golf bag 100 may include a protective layer 135 which may extend along the entire length of bag portion 105 and cap 110. For example, protective layer 135 may include a cap protective layer 135*a* and a bag portion protective layer 135*b* (collectively referred to as protective layer 135). Protective layer 135 may be formed of a flexible but durable material. Exemplary materials for protective layer 135 may be polymer foam encased in rubber, or their equivalents. Protective layer 135 may vary in width from wide to narrow to wide, which will be discussed below. However, a middle section of protective layer 135 may be less wide than other portions of protective layer 135 in order to increase flexibility of golf bag 100 between bag portion 105 and cap 110. In this manner, golf bag 100 may be disposed on an incline and still contact the ground along the length of golf bag 100 due to the flexibility provided by the narrowed protective layer 135.

Golf bag 100 may be fitted with a plurality of pockets, such as pocket 140, disposed along protective layer 135 (e.g., parallel and proximate to protective layer 135), pocket 145 disposed in an arc which terminates on either end at an approximate midline drawn through a vertical axis of golf bag 100. Another pocket 150 may be disposed in base 155 and may include a zipper that traverses base 155 circumferentially to seal pocket 150.

Figure 2:
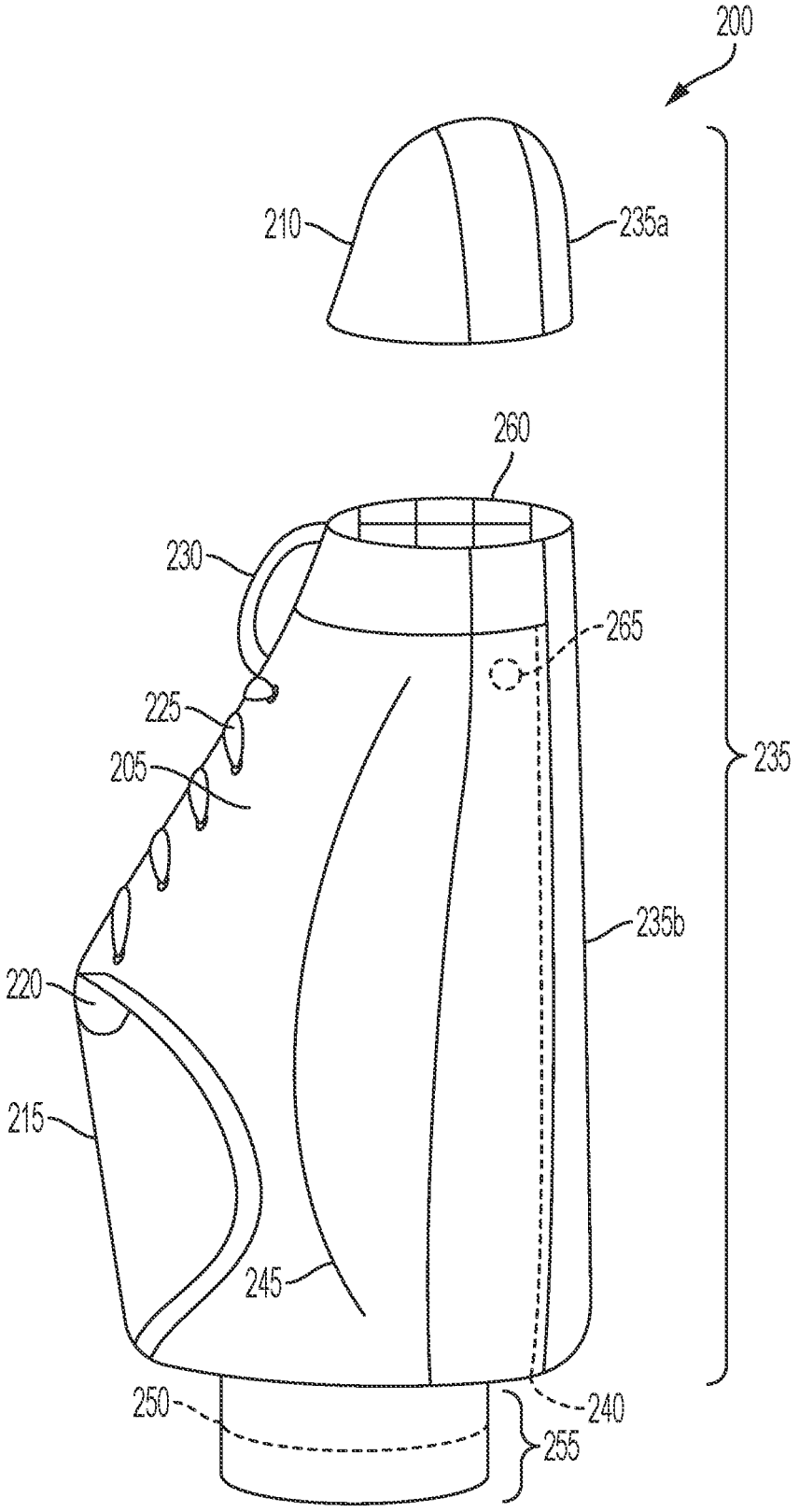
FIG. 2 illustrates a side view of a golf bag with detached cap.

FIG. 2 illustrates a side view of a golf bag 200 with a bag portion 205 and detached cap 210. Golf bag 200 may be similar in implementation and description to golf bag 100 shown and described above with respect to FIG. 1. Bag portion 205 and cap 210 may be made from natural and synthetic materials such as leather, polymers, and plastic. Bag portion 205 may include a pocket 215 which may be generally circular in shape and which, optionally, may meet with a tongue 220 to open and close. For example, tongue 220 may include a magnet latch which interfaces with pocket 215 to close pocket 215 and, thereby, also seal a pocket contained under tongue 220. Bag portion 205 may further be fitted with lacing 225 which traverses, preferably, in an "X" shaped crossing pattern. Lacing 225 may be an "open" pocket in which lacing material may retain items within lacing 225 while at the same time allow items to pass through lacing 225. For example, a yardage book, package of golf tees, or a bottle of water may be inserted under lacing 225 and retained for use during the game. Bag portion 205 may further be fitted with a handle 230 as a convenient handhold for picking up and manipulating golf bag 200. Handle 230 may also serve as a connection point for an optional shoulder strap (not shown) which allows a user to hang the weight of the bag on their shoulder rather than solely by hand.

On an exterior surface of both bag portion 205 and cap 210 along a side that is opposite the side of golf bag 200 that includes handle 230, for example, golf bag 200 may include a protective layer 235 which may extend along the entire length of bag portion 205 and cap 210. For example, protective layer 235 may include a cap protective layer 235*a* and a bag portion protective layer 235*b* (collectively referred to as protective layer 135). Protective layer 135 may be formed of a flexible but durable material. Exemplary materials for protective layer 135 may be polymer foam encased in rubber, or their equivalents. As shown in FIG. 2, cap 210 is removable from bag portion 205. Cap 210 may be sized commensurately with bag portion 205 to allow cap 210 to connect to bag portion 205 by a friction fit, snaps, buttons, or other connectors known in the art. Cap 210 when installed on bag portion 205 may appear to be virtually seamless by virtue of a connection between cap 210 and bag portion 205.

Golf bag 200 may fitted with a plurality of pockets, such as pocket 240, disposed along protective layer 235 (e.g., parallel and proximate to protective layer 235), pocket 245 disposed in an arc which terminates on either end at an approximate midline drawn through a vertical axis of golf bag 200. Another pocket 250 may be disposed in base 255 and may include a zipper that traverses base 255 circumferentially to seal pocket 250.

Golf bag 200 may further include full length club dividers 260. Full length club dividers may be disposed within an internal cavity of golf bag 200 and may extend from a top of bag portion 205 to base 255 to create separate cavities that keep individual golf clubs from contacting other individual golf clubs within golf bag 200. Any number of full length club dividers 260 may be provided within golf bag 200.

Finally, golf bag 200 may further include an umbrella holder 265. Umbrella holder 265 may be fitted along a vertical axis of golf bag 200 such that an umbrella disposed in umbrella holder 265 may provide rain shelter for golf bag 200 when golf bag 200 is stood on end. Alternatively, umbrella holder 265 may be further be fitted along a horizontal axis of golf bag 200 such that an umbrella disposed in umbrella holder 265 may provide rain shelter for golf bag 200 when golf bag 200 is disposed on protective layer 235 (e.g., on the ground). Alternatively, umbrella holder 265 may be adjustable to allow umbrella holder to be selectively rotated to be vertically positioned or horizontally positioned depending on the users intended resting position for golf bag 200.

Figure 3:
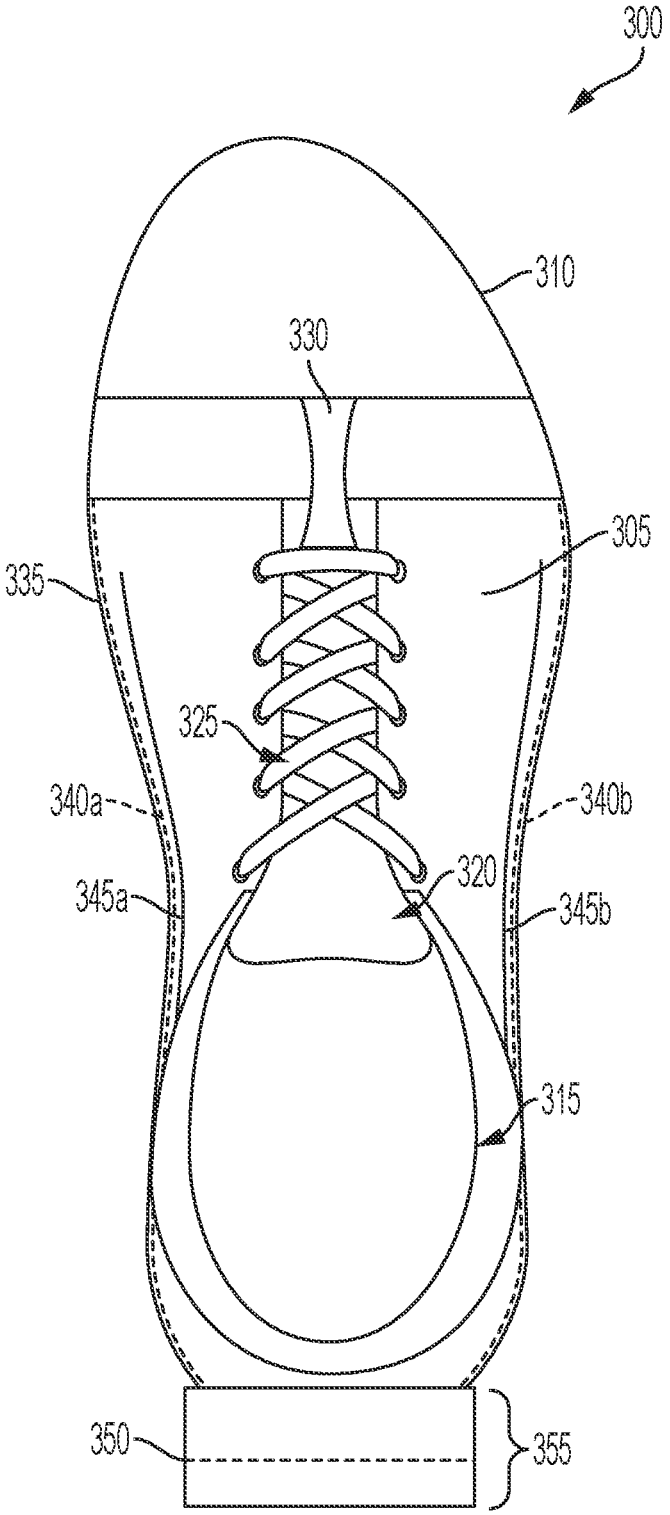
FIG. 3 illustrates a front view of a golf bag with installed cap.

FIG. 3 illustrates a front view of a golf bag 300 having a bag portion 305 with installed cap 310. Both bag portion 305 and cap 310 may be made from natural and synthetic materials such as leather, polymers, and plastic. Bag portion 305 may include a pocket 315 which may be generally circular in shape and which, optionally, may meet with a tongue 320 to open and close. For example, tongue 320 may include a magnet latch which interfaces with pocket 315 to close pocket 315 and, thereby, also seal a pocket contained under tongue 320. Bag portion 305 may further be fitted with lacing 325 which traverses, preferably, in an "X" shaped crossing pattern. Lacing 325 may be an "open" pocket in which lacing material may retain items within lacing 325 while at the same time allow items to pass through lacing 325. For example, a yardage book, package of golf tees, or a bottle of water may be inserted under lacing 325 and retained for use during the game. Bag portion 305 may further be fitted with a handle 330 as a convenient handhold for picking up and manipulating golf bag 300. Handle 330 may also serve as a connection point for an optional shoulder strap (not shown) which allows a user to hang the weight of the bag on their shoulder rather than solely by hand.

On an exterior surface of both bag portion 305 and cap 310 along a side that is opposite the side of golf bag 300 that includes handle 330, for example, golf bag 300 may include a protective layer 335 which may extend along the entire length of bag portion 305 and cap 310. Golf bag 300 may fitted with a plurality of pockets, such as pockets 340*a* and 340*b*, disposed, respectively, along opposing sides of protective layer 335 (e.g., parallel and proximate to protective layer 335), pocket 345*a* and 345*b* disposed, respectively on opposing sides of golf bag 300, in an arc which terminates on either end at an approximate midline drawn through a vertical axis of golf bag 300. Another pocket 350 may be disposed in base 355 and may include a zipper that traverses base 355 circumferentially to seal pocket 350.

Figure 4:
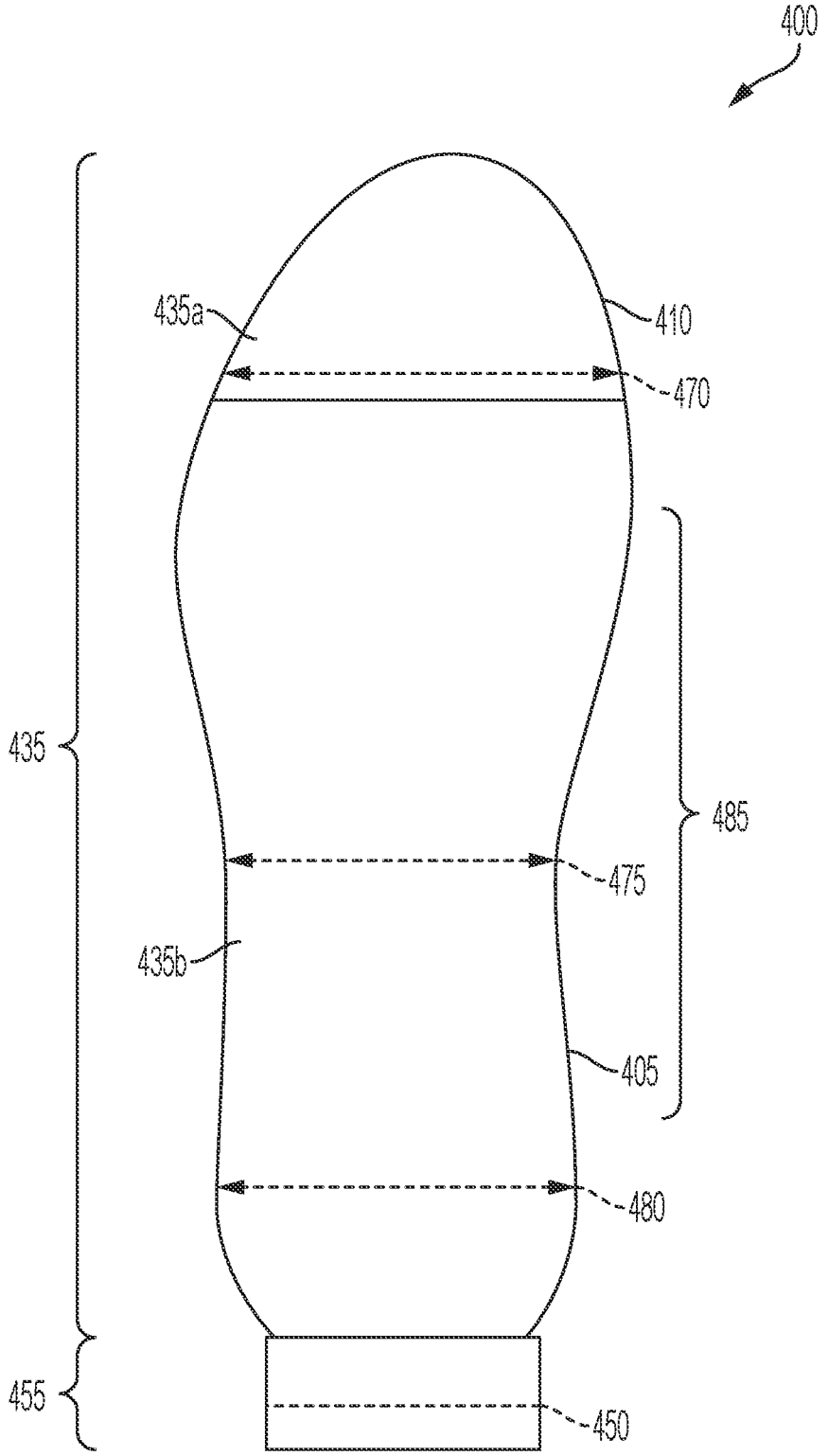
FIG. 4 illustrates a rear view of a golf bag with installed cap.

FIG. 4 illustrates a rear view of a golf bag 400 with a bag portion 405 and detachable cap 410. Golf bag 400 may be similar in implementation and description to golf bags 100, 200, and 300 shown in FIGS. 1-3, respectively. As shown in FIG. 4, golf bag 400 includes a protective layer 435 which extends along an entire exterior length of golf bag 400 (e.g., extends along cap 410 with protective layer 435*a* and bag portion 405 with protective layer 435*b*), including the entire exterior length of bag portion 405 and the entire exterior length of cap 410. Golf bag 400 may further include a base 455 in which a pocket 450 is installed.

As shown in FIG. 4, protective layer 435 may have different widths. As shown in FIG. 4, protective layer 435 long cap 410 may have a first width 470, a second width 475, and a third width 480 where both the first width 470 and third width 480 are wider than second width 475. First width 470 may be identified as being approximately similar to a width of protective layer 435 at a connection between cap 410 and bag portion 405. Second width 475 may be identified as being located at an approximate midpoint of golf bag 400 (from top of cap 410 to base 455). Third width 480 may be identified as a widest point between second width 475 and base 455.

The varying widths of protective layer 435 in golf bag 400 allow for both stability from left to right while also allowing for flexibility between cap 410 and bag portion 405. That is to say that golf bag 400 may be stable and not tip over from left to right while also allowing golf bag 400 to be set on an incline such that a top end of cap 410 or a top end of bag portion 405 may be disposed higher or lower than a bottom end of bag portion 405 and still remain stable (e.g., upright without tipping over regardless of incline or other unevenness of the ground).

Finally, it should be noted that protective layer 435 may include convex curve 485 disposed on one side of protective layer 435. Convex curve 485 may be conveniently positioned such that protective layer 435 follows the curvature of a person's lower back. In this manner, golf bag 400 may be held comfortably, particularly by use of a shoulder strap, by allowing convex curve 485 to wrap around the lower back of a user.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A golf bag comprising:
a protective layer;
a bag portion of the golf bag; and
a base disposed at a bottom of the golf bag;
wherein the golf bag includes a plurality of sides,
wherein the protective layer is connected to and forms one side among the plurality of sides of the golf bag, the one side among the plurality of sides of the golf bag disposing the protective layer along an exterior of the golf bag and along an entire length of the bag portion of the golf bag,
wherein the bag portion of the golf bag is disposed on at least another one of the plurality of sides of the golf bag, different from the one side along which the protective layer is disposed, and
wherein the protective layer is constructed using a material that is different from a material from which the bag portion of the golf bag is constructed.

2. The golf bag of claim 1, wherein the golf bag further includes a plurality of full length dividers disposed within the golf bag.

3. The golf bag of claim 2, wherein the golf bag includes a cap, the cap including a protective layer connected to one side of the cap included in a cap portion of the golf bag.

4. The golf bag of claim 3, wherein the cap portion of the golf bag covers a plurality of full length dividers disposed within the golf bag.

5. The golf bag of claim 1, where the bag portion of the golf bag includes one or more pockets.

6. The golf bag of claim 1, wherein the bag portion of the golf bag further includes lacing disposed in a crossing pattern on the bag portion of the golf bag.

7. The golf bag of claim 1, wherein the base further includes a pocket.

8. The golf bag of claim 1, further comprising a handle.

9. The golf bag of claim 1, further comprising an umbrella holder.

10. The golf bag of claim 1, further comprising a tongue disposed under lacing on the bag portion of the golf bag.

11. The golf bag of claim 1, wherein the protective layer includes a first width on a cap portion of the golf bag.

12. The golf bag of claim 11, wherein the protective layer includes a second width that is less wide than the first width on the bag portion of the golf bag.

13. The golf bag of claim 12, wherein the protective layer includes a third width that is wider than the second width but narrower than the third width on the bag portion of the golf bag.

14. The golf bag of claim 13, wherein the protective layer extends onto a cap portion of the golf bag.

15. The golf bag of claim 1, wherein the protective layer includes a convex curve along one side of the protective layer.

16. The golf bag of claim 1, wherein the material from which the protective layer is constructed, is rubber.

17. The golf bag of claim 1, wherein the base is disposed on an end of the golf bag that is opposite an end of the golf bag that includes a cap portion of the golf bag.

18. The golf bag of claim 1, wherein the golf bag includes a removable cap that includes a protective layer on the cap.

19. A golf bag, comprising:

a protective layer;

a bag portion of the golf bag; and a base disposed at a bottom of the golf bag;

wherein the golf bag includes a plurality of sides, wherein the protective layer is connected to and forms one side among the plurality of sides of the golf bag, the one side among the plurality of sides of the golf bag disposing the protective layer along an exterior of the golf bag and along an entire length of the bag portion the golf bag, wherein the bag portion of the golf bag is disposed on at least another one of the plurality of sides of the golf bag, different from the one side along which the protective layer is disposed, wherein the protective layer is constructed using a material that is different from a material from which the bag portion of the golf bag is constructed, wherein the protective layer includes a first width on a cap portion of the golf bag, a second width on a bag portion of the golf bag, and a third width on a bag portion of the golf bag, and wherein the first width is wider than the second width and the third width, the second width is narrower than the first width and the third width, and the third width is narrower than the width of the first width but wider than the width of the second width.

20. The golf bag of claim 19, wherein the second width is located at an approximate midpoint of the golf bag.

* * * * *